US007685948B2

(12) United States Patent
Tezuka

(10) Patent No.: US 7,685,948 B2
(45) Date of Patent: Mar. 30, 2010

(54) TRACK TRAVELING TOY

(75) Inventor: Tomohiro Tezuka, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 72 days.

(21) Appl. No.: 12/010,198

(22) Filed: Jan. 22, 2008

(65) Prior Publication Data

US 2008/0173726 A1 Jul. 24, 2008

(30) Foreign Application Priority Data

Jan. 22, 2007 (JP) ..... 2007-011636
Mar. 2, 2007 (JP) ..... 2007-052649

(51) Int. Cl.
*B61K 7/00* (2006.01)

(52) U.S. Cl. ..... 104/252; 104/53; 104/250; 104/251; 104/253; 104/260

(58) Field of Classification Search ..... 104/249, 104/250, 252, 251, 253, 259, 260, 295, 54, 104/60, 24, 29, 28, 30, 31, 140, 141, 53; 105/238.2, 29.2; 238/10 A, 10 E, 10 R; 246/122 A, 246/134; 446/444, 445, 446, 447
See application file for complete search history.

(56) References Cited

U.S. PATENT DOCUMENTS 3,481,279 A * 12/1969 Cooper ..... 104/60
4,045,908 A * 9/1977 Ensmann et al. ..... 446/441

FOREIGN PATENT DOCUMENTS

| | | |
|---|---|---|
| GB | 512669 | 9/1939 |
| GB | 1194409 | 11/1967 |
| JP | 7096081 | 4/1995 |
| JP | 2004-261495 | 9/2004 |
| JP | 2005-052214 | 3/2005 |
| JP | 2005-211621 | 8/2005 |
| JP | 2005-336992 | 12/2005 |

OTHER PUBLICATIONS

Abstract, Japanese Publication No. 7096081, published Apr. 11, 1995.
Abstract, Japanese Publication No. 2005-052214, published Mar. 3, 2005.
Abstract, Japanese Publication No. 2005-211621, published Aug. 11,2005.
Abstract, Japanese Publication No. 2005-336992, published Dec. 8, 2005.

(Continued)

*Primary Examiner*—Mark T Le
(74) *Attorney, Agent, or Firm*—Staas & Halsey LLP

(57) ABSTRACT

A track traveling toy, including: a track; at least a part of the track being made to be a double track; and automotive vehicle stopping sections which are respectively provided on railway tracks of the double track, wherein an automotive vehicle entering the railway track on one side operates the stopping section of the railway track on the one side to stop the automotive vehicle on the railway track, and operates the stopping section on the other railway track to release a stopping state of an automotive vehicle on the railway track.

8 Claims, 14 Drawing Sheets

OTHER PUBLICATIONS

Japanese Office Action in Application No. 2007-052649, mailed Sep. 24, 2008.

Chinese Office Action in Application No. 2007-10091976.4, issued Aug. 21, 2009.

"Thomas & Friends 'Calling All Engines'", Thomas Airport Set Instructions from TOMY® website (Copyright date 2005) URL: http://www.tomy.co.uk/__download/WSBQWPOJ.pdf (Retrieved May 15, 2008).

TOMY® Thomas & Friends Motor Road & Rail: "Calling All Engines"—Thomas Airport Set from Amazon.co.uk website. Note customer review dated Jan. 6, 2006. URL: http://www.amazon.co.uk.Tomy-Thomas-Friends-Motor-Road/dp/B0009IYH0W (Retrieved May 15, 2008).

Search Report issued in corresponding United Kingdom Application No. GB0800725.4 dated May 16, 2008.

* cited by examiner

TRACK TRAVELING TOY

BACKGROUND OF THE INVENTION

1. Field of the Invention

The present invention relates to a track traveling toy, and more particularly to a track traveling toy to make a plurality of automotive vehicles alternately travel.

2. Related Art

As a track traveling toy to make a vehicle travel on a track, for example, Plarail available from Tomy Company, Ltd. is known. Plarail forms a looped track by connecting linear rails, curved rails, and the like, and makes a vehicle travel on the track (see, for example, Japanese Patent Application Laid-Open Publication No. 2004-261495).

Now, the above track traveling toy can make only one train travel at least one looped track, and consequently the play becomes monotonous.

SUMMARY OF THE INVENTION

The present invention was made to solve such a problem. It is, therefore, a main object of the present invention to provide a track traveling toy capable of making a plurality of vehicles alternately travel.

According to an aspect of the present invention, there is provided a track traveling toy including: a track; at least a part of the track being made to be a double track; and automotive vehicle stopping sections which are respectively provided on railway tracks of the double track, wherein an automotive vehicle entering the railway track on one side operates the stopping section of the railway track on the one side to stop the automotive vehicle on the railway track, and operates the stopping section on the other railway track to release a stopping state of an automotive vehicle on the railway track.

BRIEF DESCRIPTION OF THE DRAWINGS

The above and other objects, advantage and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENTS

In the following, a track traveling toy according to the present invention will be described with reference to the attached drawings.

Figure 1:
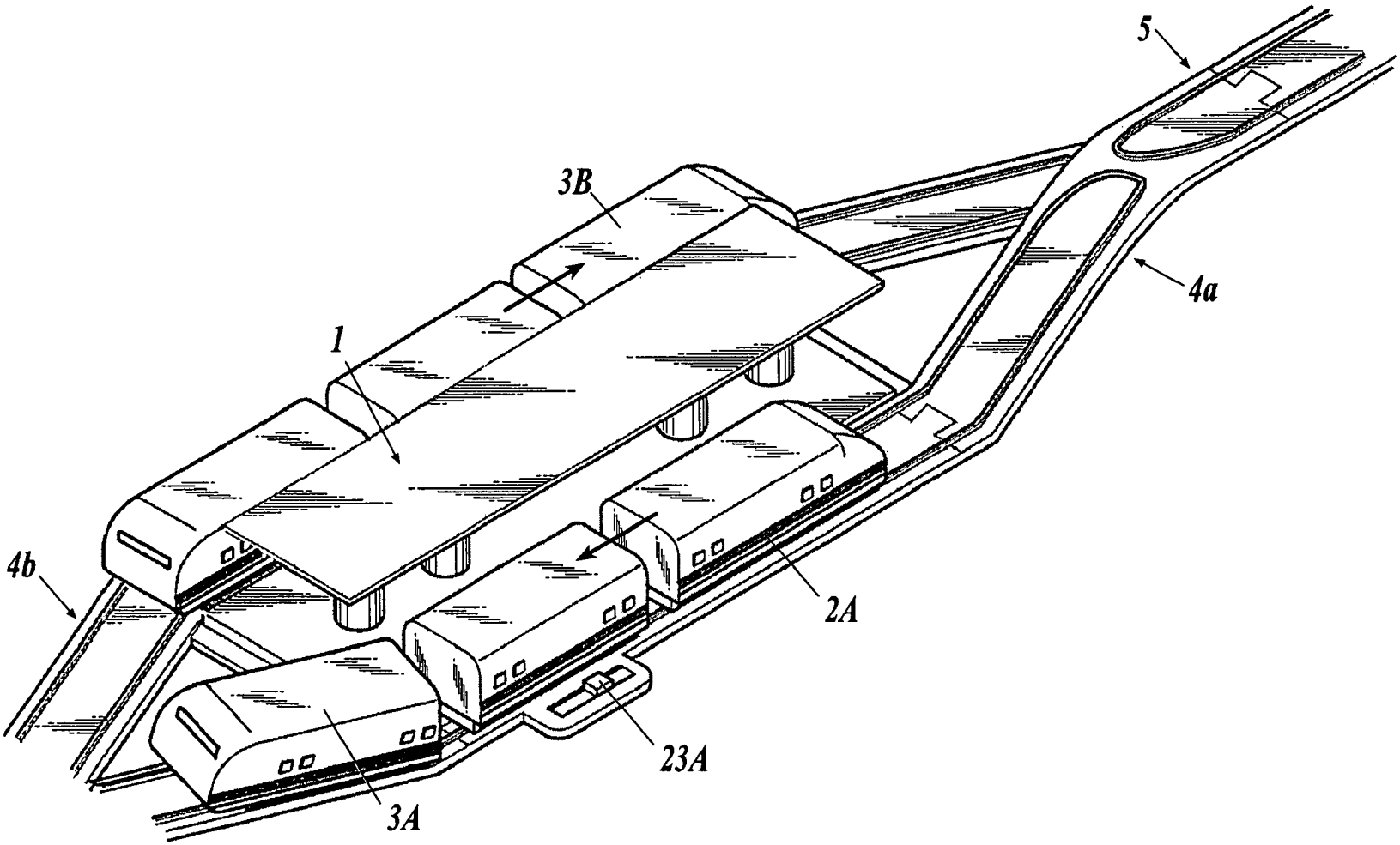
FIG. 1 is a perspective view of a platform conceptually showing the track traveling toy according to the present invention.
Figure 2:
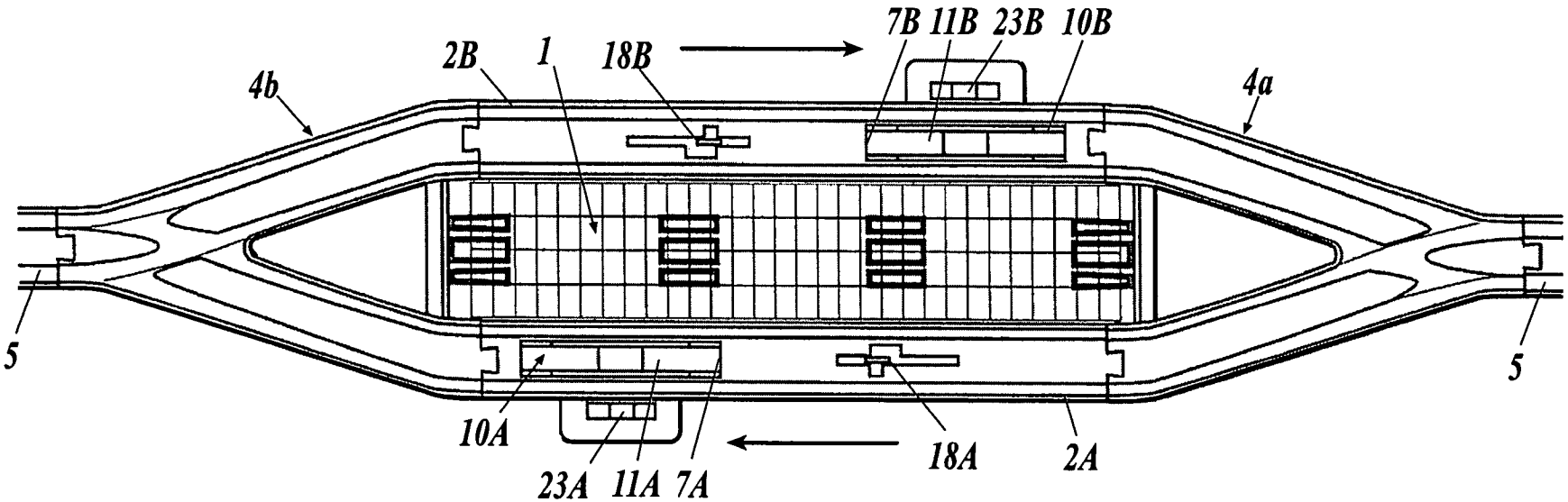
FIG. 2 is a conceptual plan view of the platform of the track traveling toy according to the present invention.
Figure 6:
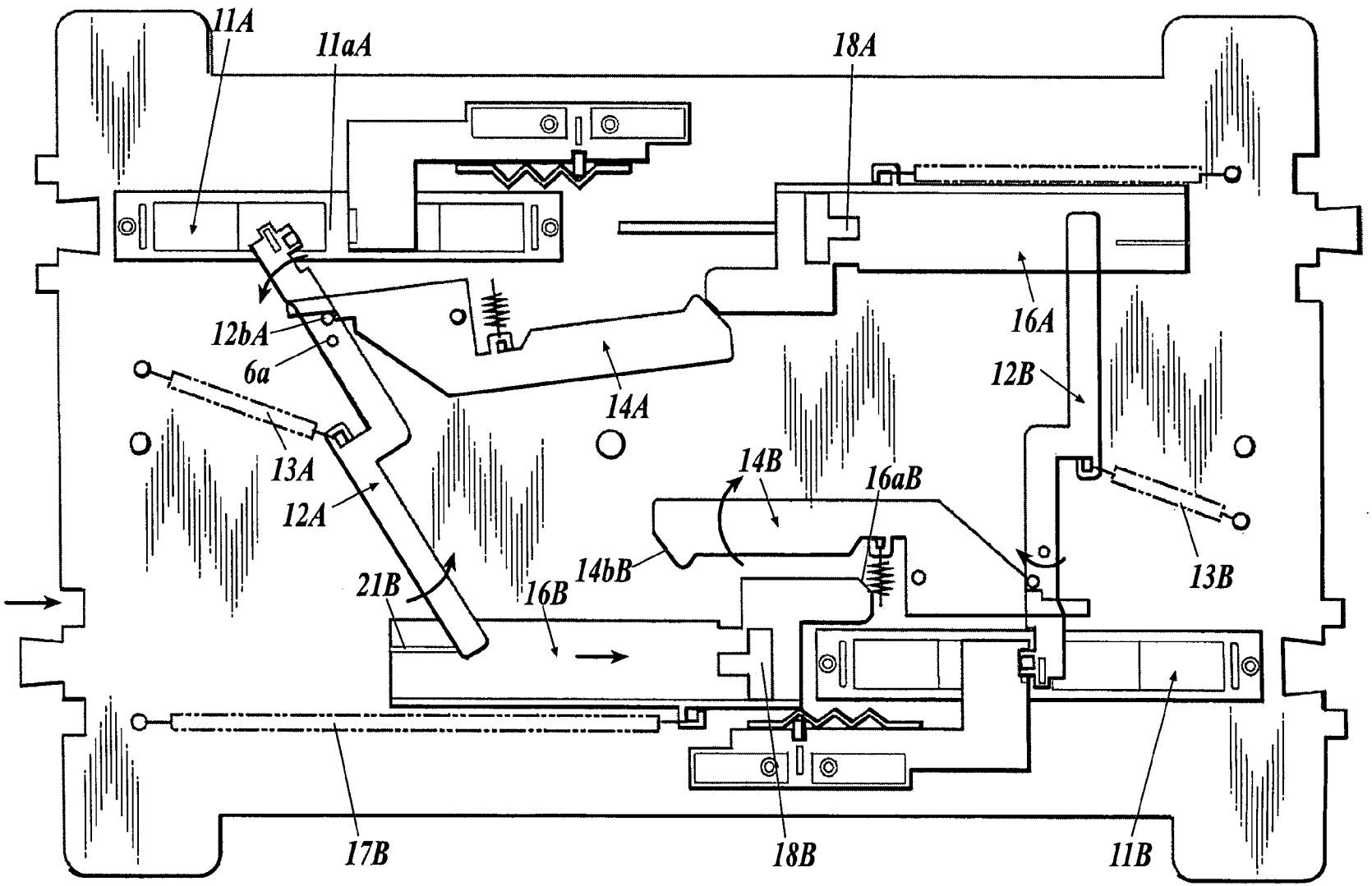
FIG. 6 is a bottom view showing the inner parts on the back surface side of the base of the platform according to the present invention.
Figure 7:
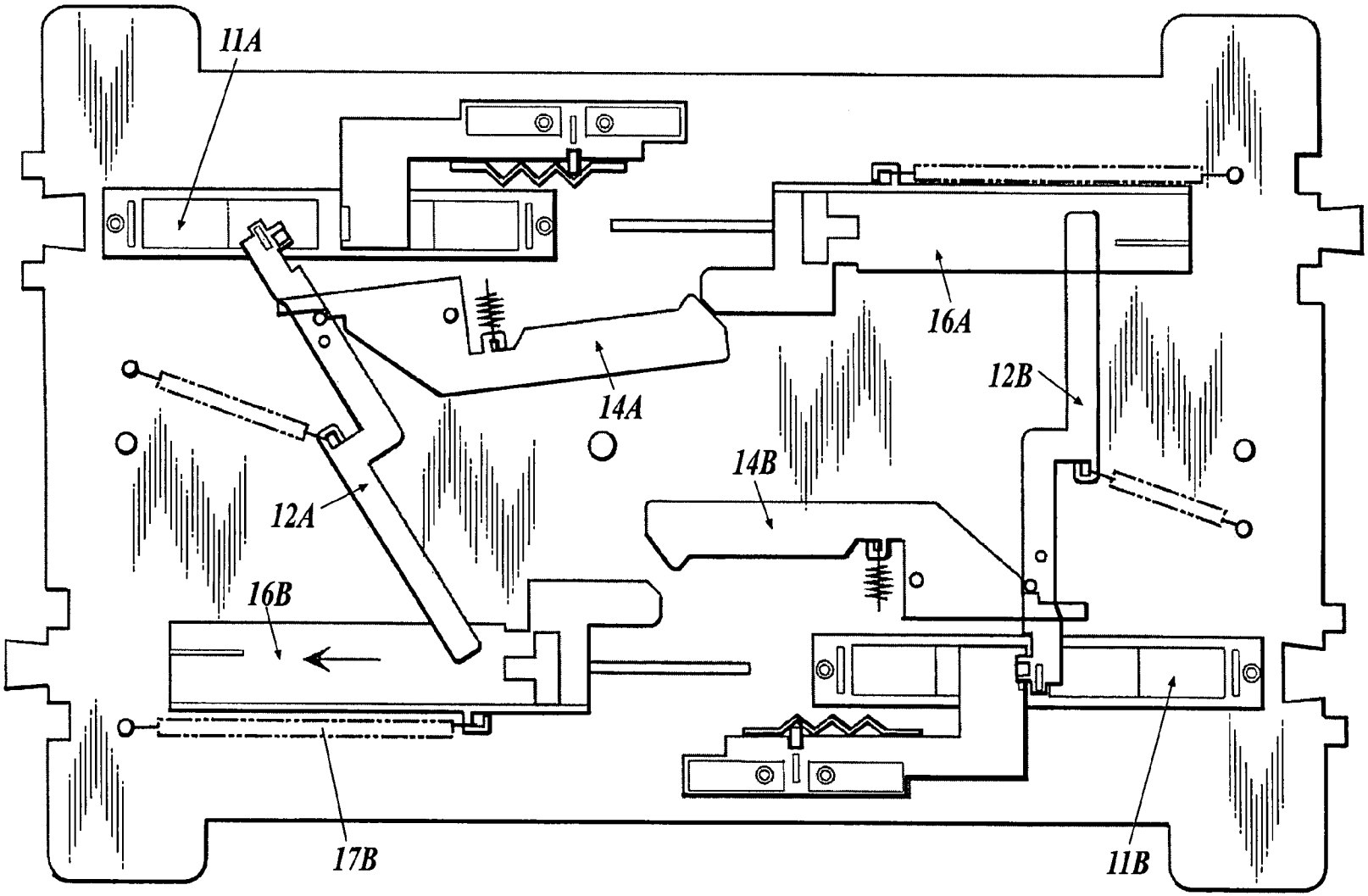
FIG. 7 is a bottom view showing the inner parts on the back surface side of the base of the platform according to the present invention.
Figure 8:
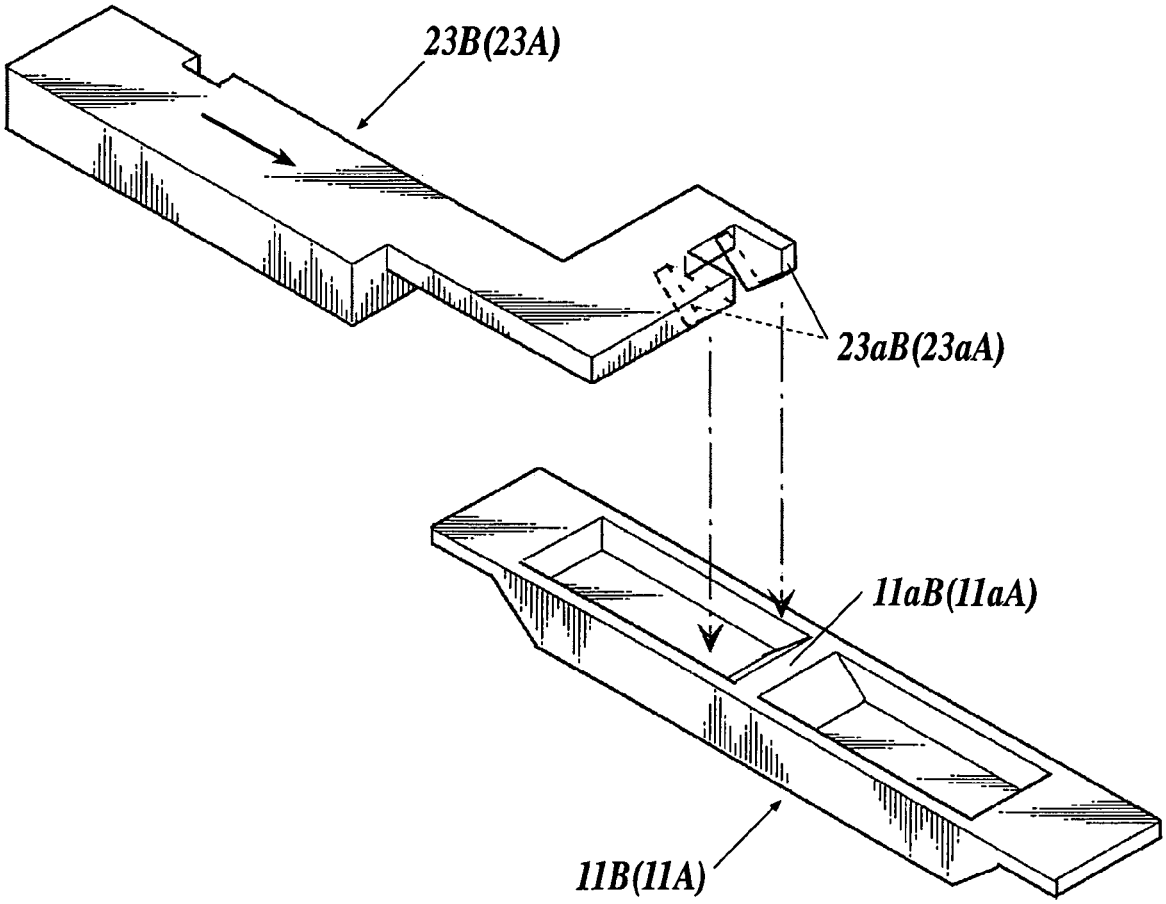
FIG. 8 is a perspective view showing a pedestal and a mode changing switch according to the present invention.
Figure 9:
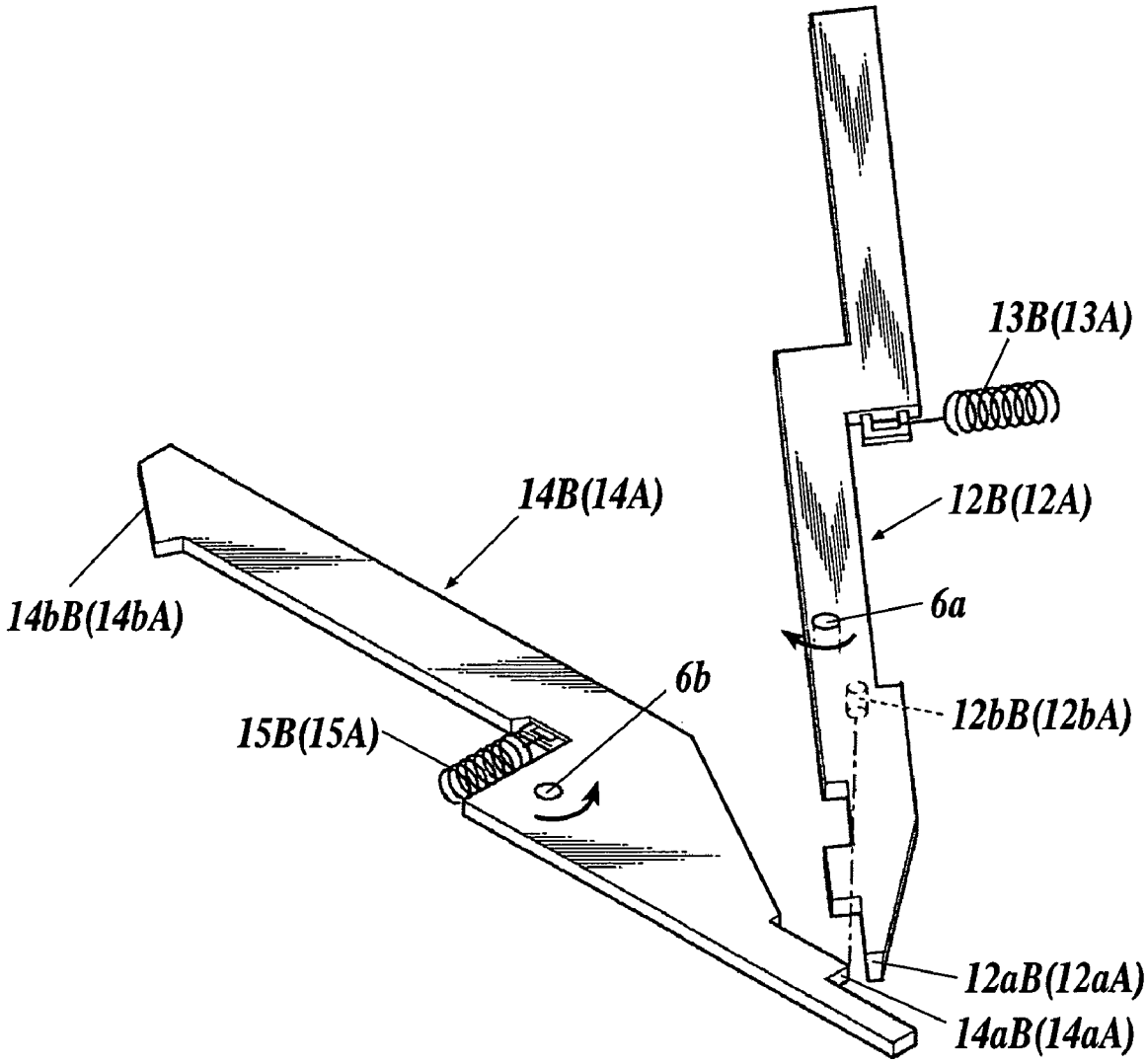
FIG. 9 is a perspective view showing an actuating lever and a locking lever according to the present invention.
Figure 10:
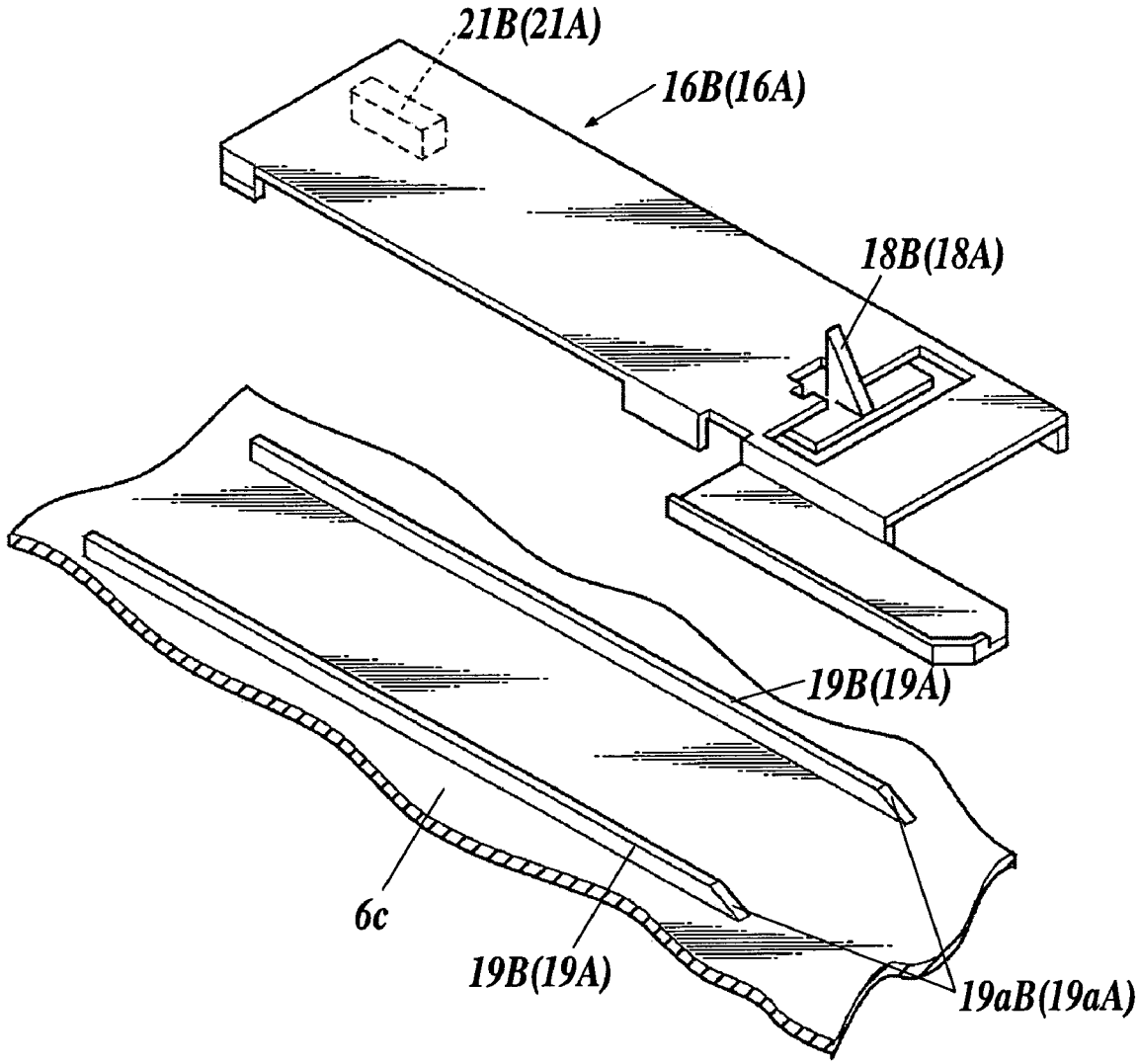
FIG. 10 is a perspective view showing a slider and rails on the base bottom board according to the present invention.
Figure 11A:
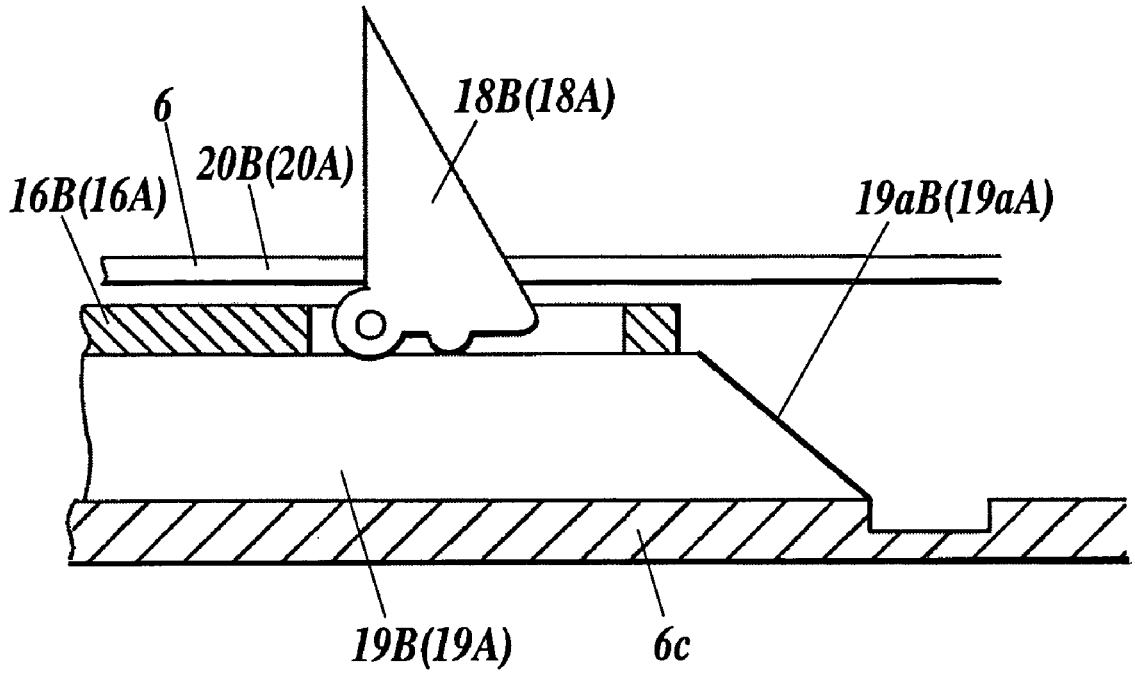
FIG. 11A is a sectional view showing the operation of the slider according to the present invention.
Figure 11B:
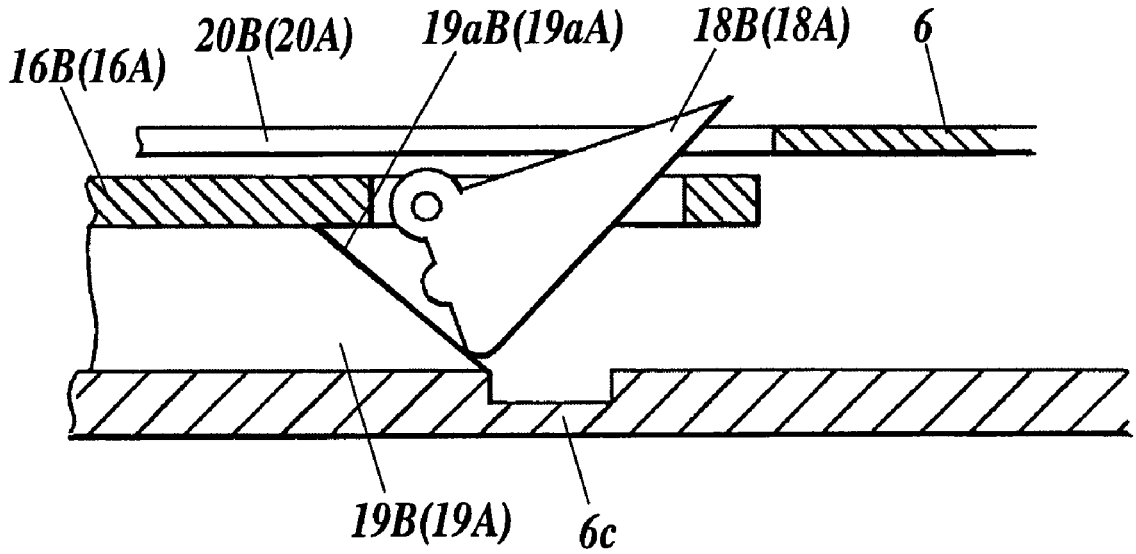
FIG. 11B is a sectional view showing the operation of the slider according to the present invention.
Figure 12:
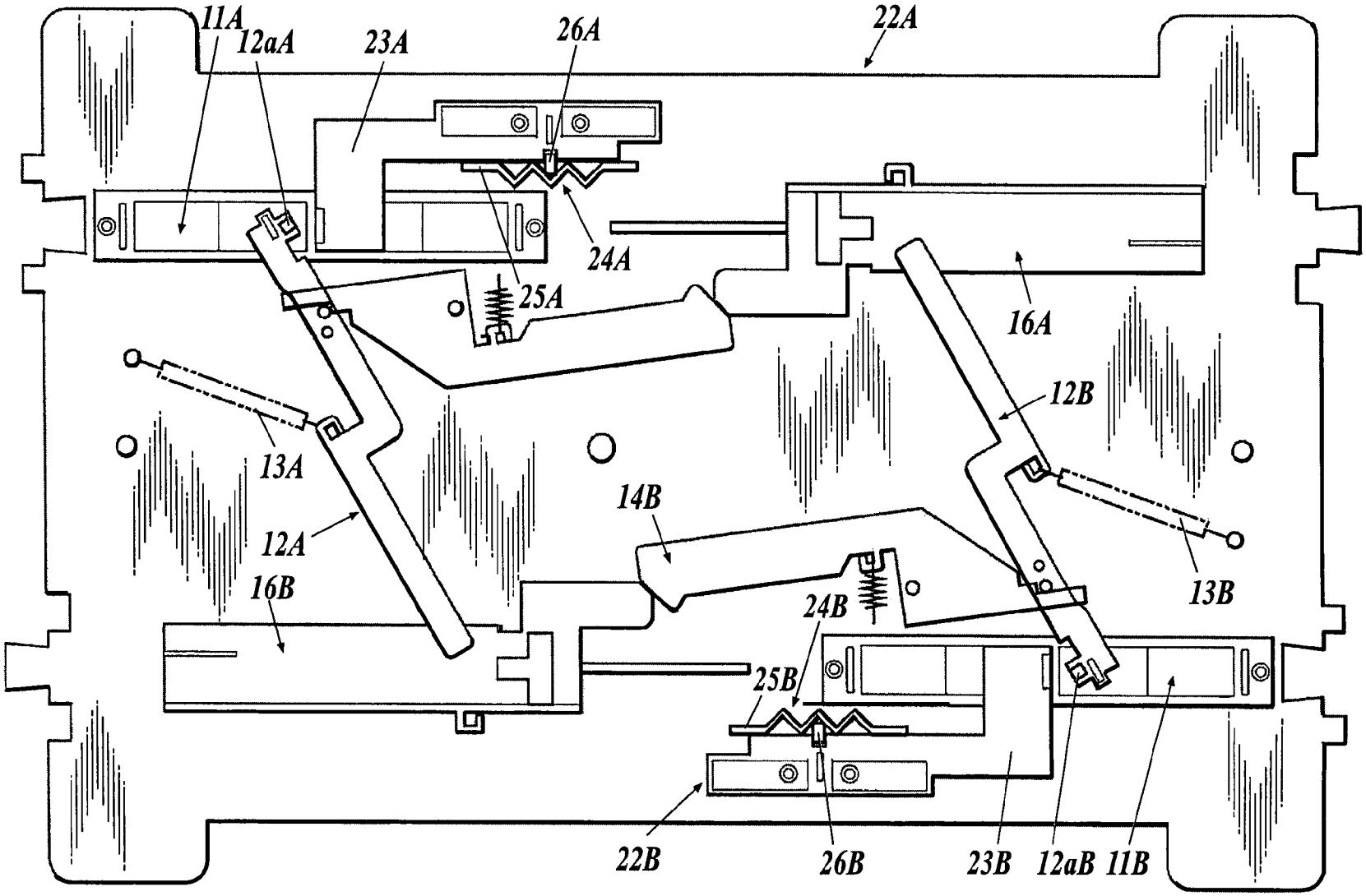
FIG. 12 is a bottom view showing the aspects of the inner part on the back surface side in a manual mode according to the present invention.
Figure 13:
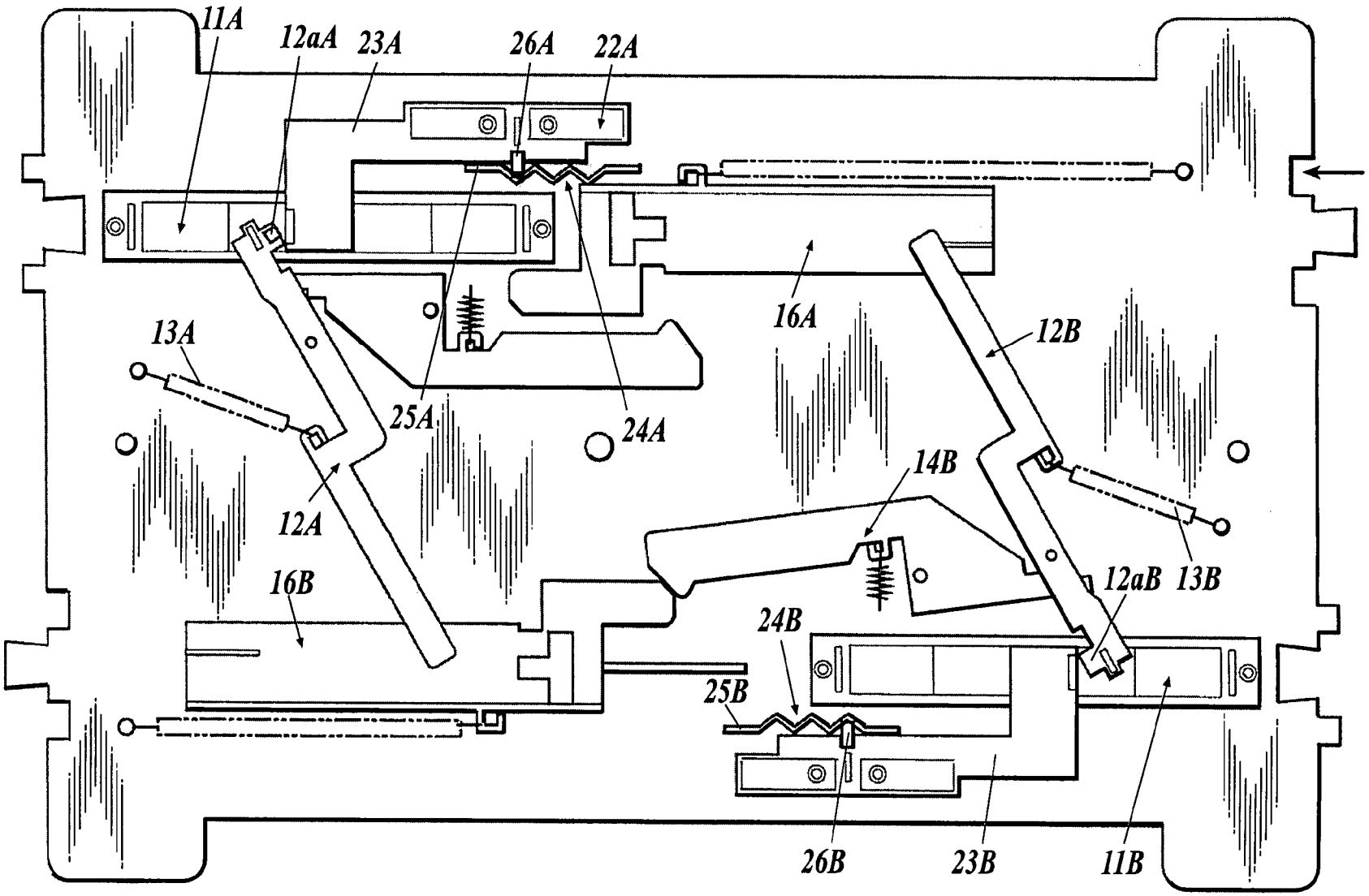
FIGS. 13 is a bottom view showing the aspects of the inner part on the back surface side in a manual mode according to the present invention.
Figure 14:
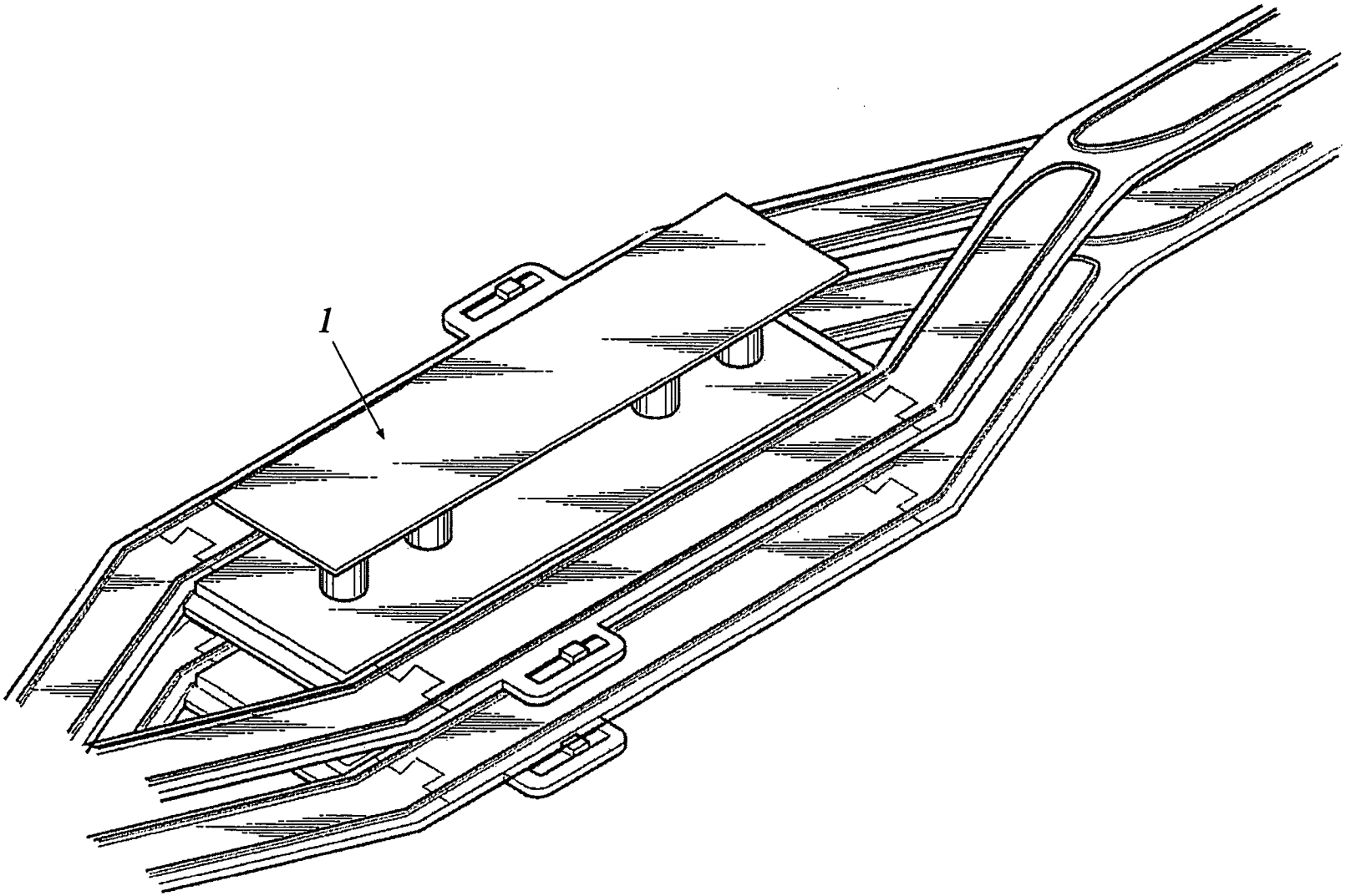
FIG. 14 is a conceptual perspective view showing a modification of the track traveling toy according to the present invention.

FIG. 1 is a perspective view of a platform conceptually showing the track traveling toy according to the present invention; FIG. 2 is a conceptual plan view of the platform; FIGS. 3-7 are bottom views showing the inner parts on the back surface side of the base of the platform according to the present invention in the order of the operation thereof; FIG. 8 is a perspective view showing a pedestal and a mode changing switch; FIG. 9 is a perspective view showing an actuating lever and a locking lever; FIG. 10 is a perspective view showing a slider and rails on the base bottom board; FIGS. 11A and 11B are sectional views showing the operation of the slider; FIGS. 12 and 13 are bottom views showing the aspects of the inner part on the back surface side in a manual mode; and FIG. 14 is a conceptual perspective view showing a modification of the track traveling toy according to the present invention.

The track traveling toy of the present invention is a toy of stopping and starting automotive vehicles on a double track alternately. In the present embodiment, as shown in FIGS. 1 and 2, two railway tracks 2A and 2B are disposed so as to put a platform 1 between them, and the railway tracks 2A and 2B are connected to a single track 5 laid in a loop through switching railway tracks 4*a* and 4*b*, which change the courses of vehicles 3A and 3B. The vehicles 3A and 3B on the respective railway tracks 2A and 2B with the platform 1 put between them are made to travel in opposite directions.

In the track traveling toy, vehicle stopping means 10A and 10B are disposed at downstream positions of the railway tracks 2A and 2B, respectively, in the traveling directions of the vehicles 3A and 3B, respectively. The stopping means 10A and 10B are equipped with pedestals 11A and 11B, respectively, which are disposed so as to be able to freely emerge above the railway tracks 2A and 2B, respectively. The lower parts of the pedestals 11A and 11B are projected onto the back surface side of a base 6, on which the railway tracks 2A and 2B are laid, through holes 7A and 7B of the base 6, respectively, and projecting parts 11*a*A and 11*a*B projecting downward are formed on the under surfaces of the pedestals 11A and 11B, respectively (see FIG. 8).

Figure 3:
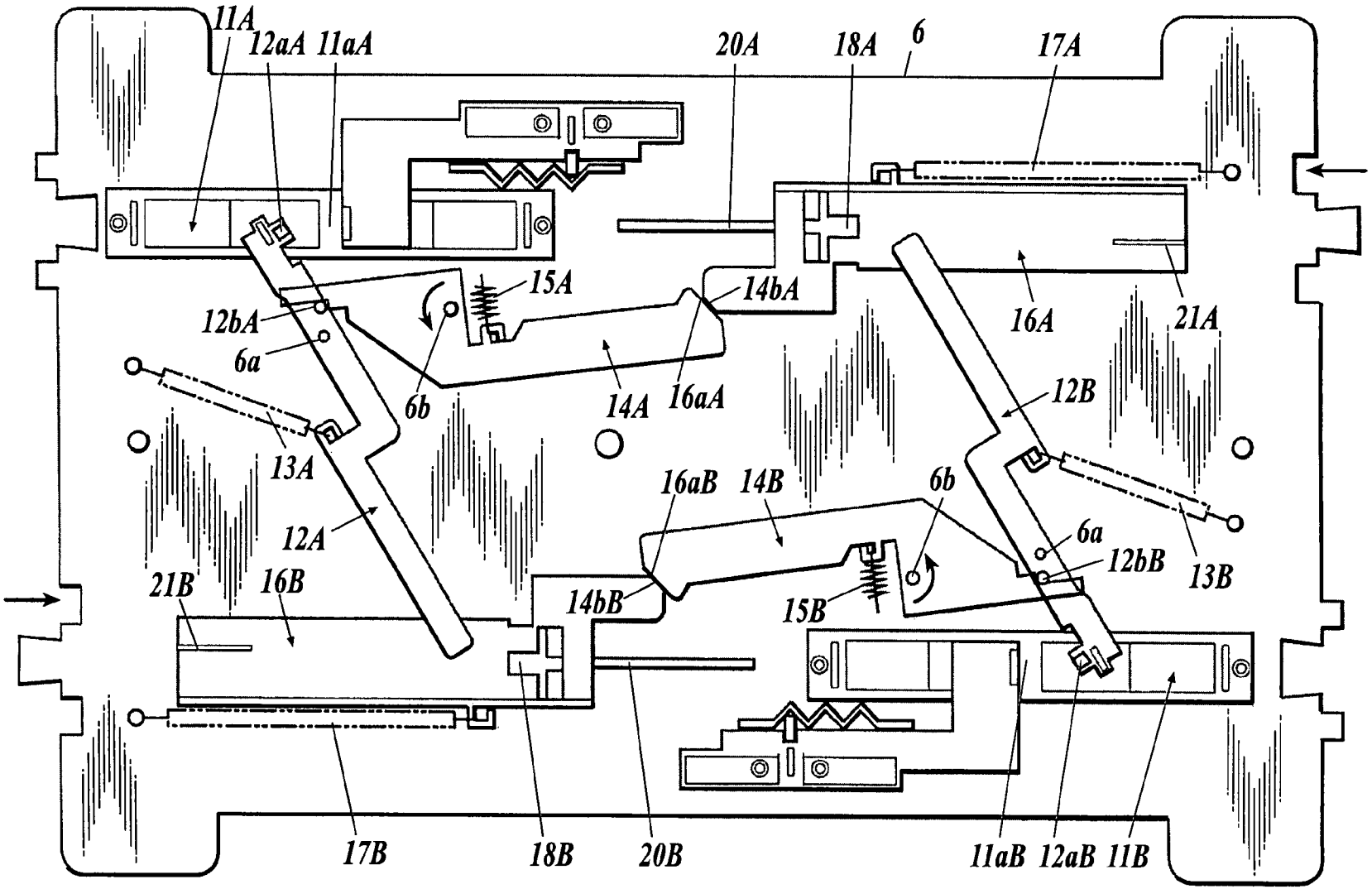
FIG. 3 is a bottom view showing the inner parts on the back surface side of the base of the platform according to the present invention.

On the other hand, as shown in FIG. 3, actuating levers 12A and 12B to raise the pedestals 1lA and 11B, respectively, are disposed on the back surface of the base 6 with shafts 6*a* put between them. The actuating levers 12A and 12B are provided with projections l2*a*A and l2*a*B on their top surfaces at their ends, respectively (see FIG. 9). The actuating levers 12A and 12B are clockwise urged in FIG. 3 around each of the shafts 6*a* by springs 13A and 13B, respectively. Moreover, pins l2*b*A and l2*b*B extending upward are provided to stand at the ends of the actuating levers 12A and 12B, respectively (see FIG. 9).

Incidentally, the parts of the projections 12*a*A and 12*a*B are suitably shown as perspective drawings in FIGS. 3-7, 12, and 13.

Moreover, locking levers 14A and 14B to lock the actuating levers 12A and 12B, respectively, in the state of being separated from the projecting parts 11*a*A and 11*a*B of the pedestals 1lA and 11B, respectively, are disposed on the back surface of the base 6 with shafts 6*b* put between them. The locking levers 14A and 14B are counterclockwise urged in FIG. 3 around the shafts 6*b* by springs 15A and 15B, respectively. Notches l4*a*A and l4*a*B are formed at the ends of the locking levers 14A and 14B, respectively, as shown in FIG. 9. The notches 14*a*A and l4*a*B engage with the pins l2*b*A and l2*b*B of the actuating levers 12A and 12B, respectively, and thereby the ends of the projections 12*a*A and 12*a*B of the actuating levers 12A and 12B are prevented from abutting the projecting parts 11*a*A and 11*a*B of the pedestals 11A and 11B, respectively.

Incidentally, the parts of the notches 14*a*A and 14*a*B and the pins 12*b*A and 12*b*B are suitably shown as perspective drawings in FIGS. 3-7, 12, and 13.

Moreover, sliders 16A and 16B are disposed on the back surface of the base 6 corresponding to upstream positions of the traveling directions of the vehicles on the railway tracks 2A and 2B, respectively. The sliders 16A and 16B are slidably installed along the railway tracks 2A and 2B, respectively. The sliders 16A and 16B are urged away from the pedestals 1lA and 11B, respectively, by springs 17A and 17B, respectively. Claws 18A and 18B to engage with entering vehicles 3A and 3B, respectively, are rotatably disposed on the sliders 16A and 16B, respectively. For example, a U-shaped engaging portion open into the front of the body of the lead vehicle is formed only on the under side of the body of the lead vehicle, and the sliders 16A and 16B are configured so that the claws 18A and 18B may engage with the U-shaped engaging portions, respectively. On the other hand, rails 19A and 19B are formed on the top surface of the base bottom board 6*c* of the base 6. The ends of the rails 19A and 19B are extended to be installed in the neighborhoods of the pedestals 11A and 11B, respectively, and inclined planes 19*a*A and 19*a*B are formed at the ends, respectively. Then, when the sliders 16A and 16B are situated at positions distant from the pedestals 1lA and 11B, respectively, the claws 18A and 18B are projected above the base 6 from slits 20A and 20B by the rails 19A and 19B, respectively, as shown in FIG. 1lA. Then, when the sliders 16A and 16B reach the neighborhoods of the pedestals 1lA and 11B, respectively, by movements, the claws 18A and 18B reach the portions of the inclined planes 19*a*A and 19*a*B, respectively, and the claws 18A and 18B deviate from the rails 19A and 19B, respectively, as shown in FIG. 11B. Then, the ends of the claws 18A and 18B rotate downward by their own weights. Then, because the claws 18A and 18B are separated from the vehicles 3A and 3B, respectively, the sliders 16A and 16B are returned to their original positions by the urging forces of the springs 17A and 17B, respectively. Incidentally, the returns of the sliders 16A and 16B to their original positions may be performed after the whole bodies of the vehicles 3A and 3B have passed over the tumbled claws 18A and 18B, respectively.

Moreover, projecting parts 21A and 21B are formed at the rear ends of the under surfaces of the sliders 16A and 16B, respectively. The projecting parts 21A and 21B are moved with the sliders 16A and 16B, respectively, and then separate the projections 12*a*B and 12*a*A of the actuating levers 12B and 12A, respectively, in the state of raising the pedestals 11B and 11A, respectively, from the projecting parts 11*a*B and 11*a*A of the pedestals 11B and 11A, respectively.

Moreover, cam faces 16*a*A and 16*a*B are formed at the ends of the sliders 16A and 16B, respectively. On the other hand, inclined planes 14*b*A and 14*b*B are formed at the rear ends of the locking levers 14A and 14B, respectively. Then the inclined planes 14*b*A and 14*b*B of the locking levers 14A and 14B abut against the cam faces 16*a*A and 16*a*B of the sliders 16A and 16B, respectively, and thereby the movements of the locking levers 14A and 14B rotated by the urging forces of the springs 15A and 15B, respectively, are regulated.

Then, when the sliders 16A and 16B are moved against the urging forces of the springs 17A and 17B, respectively, the locking levers 14A and 14B are clockwise rotated by the cam faces 16*a*A and 16*a*B, respectively, against the urging forces of the springs 15A and 15B, respectively.

The track traveling toy configured as above operates as follows.

In the initial state shown in FIG. 3, the sliders 16A and 16B are situated rearward (at positions most distant from the pedestals 11A and 11B, respectively) by the urging forces of the springs 17A and 17B, respectively. The locking levers 14A and 14B are counterclockwise rotated by the urging forces of the springs 15A and 15B, respectively, and their inclined planes l4*b*A and l4*b*B abut against the cam faces l6*a*A and l6*a*B of the sliders 16A and 16B, respectively. Then the locking levers 14A and 14B stop. Moreover, the actuating levers 12A and 12B are clockwise rotated by the urging forces of the springs 13A and 13B, respectively, and their pins l2*b*A and l2*b*B engage with the notches l4*a*A and l4*a*B of the locking levers 14A and 14B, respectively. Then the actuating levers 12A and 12B are locked there. Consequently, in such a state, the projections 12*a*A and 12*a*B of the actuating levers 12A and 12B are situated at positions distant from the projecting parts 11*a*A and 11*a*B of the pedestals 1lA and 11B, respectively, and the pedestals 11A and 11B are in the dropped state owing to their own weights.

Figure 4:
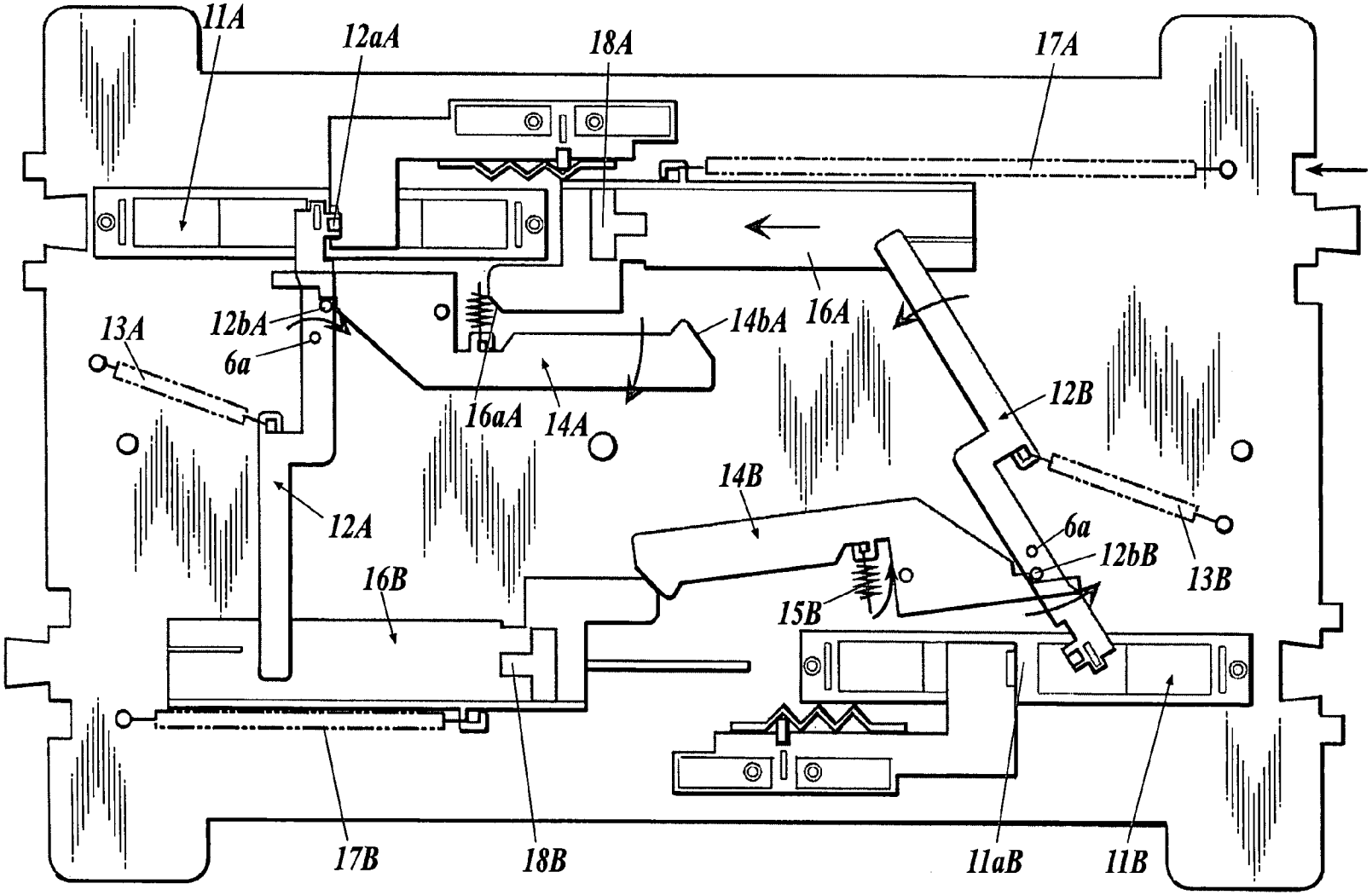
FIG. 4 is a bottom view showing the inner parts on the back surface side of the base of the platform according to the present invention.

When the vehicle 3A enters the upper railway track 2A in the state of FIG. 3, the claw 18A of the slider 16A engages with the vehicle 3A. The slider 16A is then moved into the direction of the pedestal 11A with the entering of the vehicle 3A, as shown in FIG. 4. Then, the cam face 16*a*A of the slider 16A clockwise rotates the locking lever 14A against the urging force of the spring 15A. When the locking lever 14A has been rotated in this manner, the engagement of the pin 12*b*A with the notch 14*a*A is released, and the actuating lever 12A is clockwise rotated by the urging force of the spring 13A. Then, the projection 12*a*A abuts against the projecting part 11*a*A of the pedestal 11A to push up the pedestal 11A.

Figure 5:
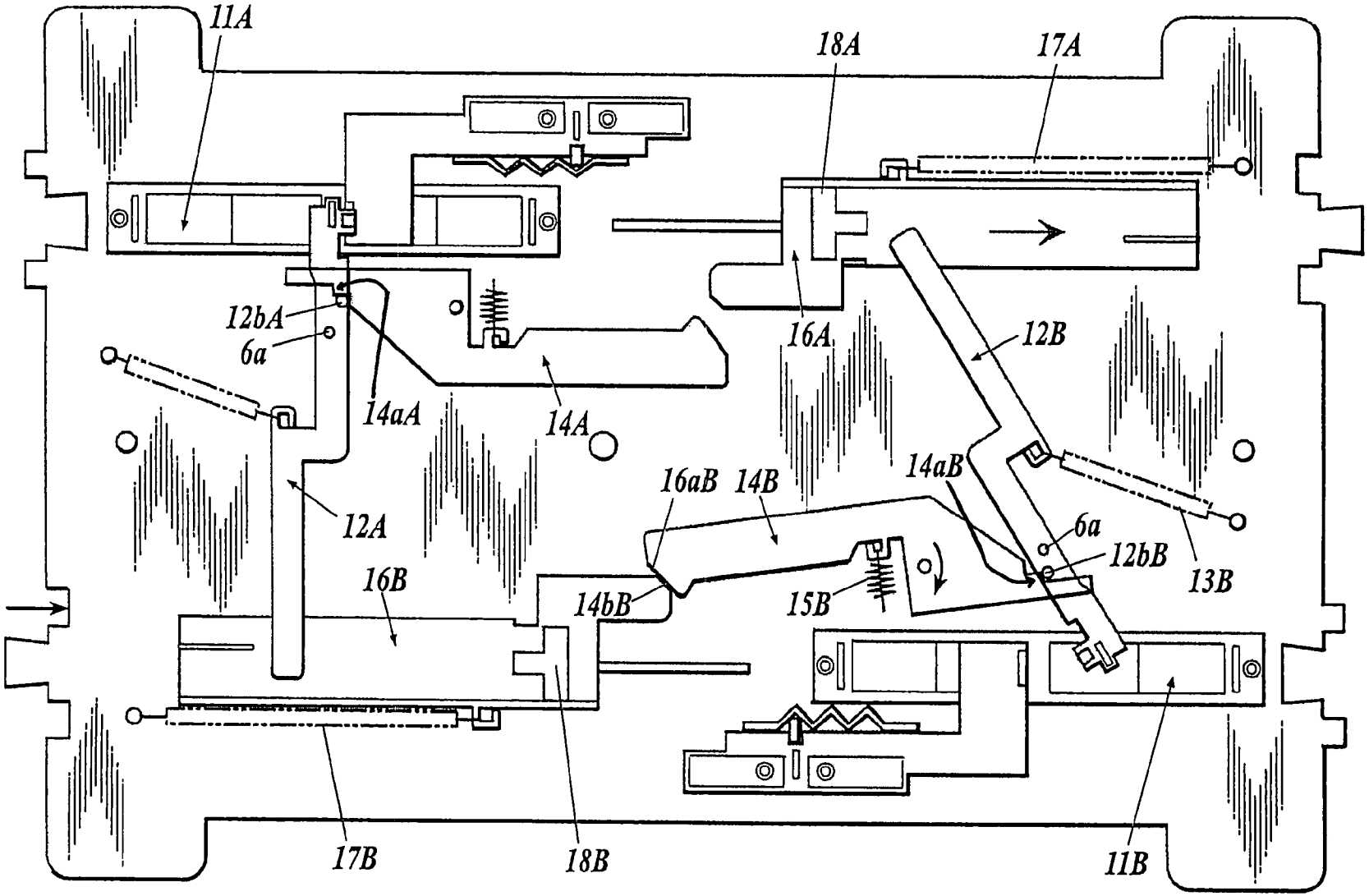
FIG. 5 is a bottom view showing the inner parts on the back surface side of the base of the platform according to the present invention.

Consequently, the entering vehicle 3A runs on the pedestal 11A. Then, because the driving wheels of the vehicle 3A separate from the railway track 2A, the vehicle 3A stops there. Incidentally, because the claw 18A of the slider 16A separates from the vehicle 3A at a stage before then, the slider 16A returns to its original position by the urging force of the spring 17A as shown in FIG. 5. Incidentally, at this time, the locking lever 14A engages with the outside of the notch 14*a*A of the actuating lever 12A, and keeps the state shown in FIGS. 4 and 5.

When the vehicle 3B enters the lower railway track 2B in the state of FIG. 5, the claw 18B of the slider 16B engages with the vehicle 3B similarly to the above case. The projecting part 21B of the slider 16B counterclockwise rotates the actuating lever 12A against the urging force of the spring 13A with the entering of the vehicle 3B as shown in FIG. 6. With the rotation, the projection 12*a*A of the actuating lever 12A separates from the projecting part 11*a*A of the pedestal 11A, and the pedestal 11A thereby drops owing to its own weight. Consequently, the vehicle 3A, which has been stopped by the pedestal 11A, starts moving. At this time, because the pin 12*b*A of the actuating lever 12A comes off the outside of the notch 14*a*A owing to the rotation of the actuating lever 12A, the locking lever 14A counterclockwise rotates to return to its initial position.

Moreover, when the slider 16B has moved into the direction of the pedestal 11B, the cam face l6*a*B of the slider 16B clockwise rotates the locking lever 14B through the inclined plane 14*b*B of the locking lever 14B against the urging force of the spring 15B. When the locking lever 14B has been rotated in this manner, the notch l4*a*B moves to release the locking of the pin 12*b*B of the actuating lever 12B. Consequently, the actuating lever 12B clockwise rotates by the urging force of the spring 13B, and the projection 12*a*B of the actuating lever 12B abuts against the projecting part of the pedestal 11B to push up the pedestal 11B. Consequently, the entering vehicle 3B runs on the pedestal 11B, and the driving wheels of the vehicle 3B separate from the railway track 2B. Then, the vehicle 3B stops there. Incidentally, because the claw 18B of the slider 16B separates from the vehicle 3B at a stage before then, the slider 16B returns to its original position by the urging force of the spring 17B as shown in FIG. 7. Incidentally, at this time, the locking lever 14B engages with the outside of the notch l4*a*B of the actuating lever 12B, and keeps the state shown in FIG. 6.

The track toy of the present invention automatically repeats the above operation, and thereby the vehicles 3A and 3B alternately repeat stopping and starting at the platform 1.

Now, the shown embodiment includes a manual mode to manually stop or start (pass) the vehicles 3A and 3B besides the above automatic mode.

The manual mode is achieved by mode changing switches 22A and 22B (see FIGS. 12 and 13). The mode changing switches 22A and 22B include slide pieces 23A and 23B, respectively, and detent mechanisms 24A and 24B to locate the slide pieces 23A and 23B, respectively.

The slide pieces 23A and 23B include projecting parts 23*a*A and 23*a*B, respectively, at ends of their top surfaces, respectively, as shown in FIG. 8.

Moreover, the detent mechanisms 24A and 24B are composed of ribs 25A and 25B, respectively, each including three concave portions, provided to stand on the base 6, and locking portions 26A and 26B, respectively, installed on the side walls of the slide pieces 23A and 23B, respectively, so as to be able to freely emerge. The locking portions 26A and 26B are kept to be in projecting states from the sidewalls, respectively, by the urging forces of not-shown springs, respectively.

When the mode changing switches 22A and 22B configured as above slide the slide pieces 23A and 23B, respectively, to engage the locking portions 26A and 26B with the middle concave portions of the ribs 25A and 25B, respectively, in the stop mode shown in FIG. 12, the projecting parts 23*a*A and 23*a*B of the slide pieces 23A and 23B abut against the projecting parts 11*a*A and 11*a*B of the pedestals 11A and 11B, respectively, and always push up the pedestals 11A and 11B, respectively. The slide pieces 23A and 23B are always kept at the positions by the detent mechanisms 24A and 24B, respectively.

In this state, even if the actuating levers 12A and 12B are rotated by the urging forces of the springs 13A and 13B, respectively, the ends of the actuating levers 12A and 12B collide with the ends of the slide pieces 23A and 23B, respectively, and are stopped there without reaching the projecting parts 11*a*A and 11*a*B of the pedestals 11A and 11B, respectively.

Moreover, when the slide pieces 23A and 23B are slid and the locking portions 26A and 26B are thereby engaged with the concave portions at the ends of the ribs 25A and 25B, respectively, in the start (pass) mode shown in FIG. 13, the ends of the slide pieces 23A and 23B are located further ahead of the projecting parts 11*a*A and 11*a*B of the pedestals 11A and 11B, respectively. In this state, the pedestals 11A and 11B are in their descended states. Moreover, in this state, it is preferable that the ends of the slide pieces 23A and 23B depress one side ends of the actuating levers 12A and 12B, respectively, to situate the pins 12*b*A and 12*b*B of the actuating levers 12A and 12B at positions, respectively, where the pins 12*b*A and 12*b*B are separated from the notches 14*a*A and 14*a*B, respectively. Consequently, even if the actuating levers 12A and 12B are rotated by the urging forces of the springs 13A and 13B, respectively, in this state, the ends of the actuating levers 12A and 12B collide with the ends of the slide pieces 23A and 23B, respectively, and are stopped there without reaching the projecting parts 11*a*A and 11*a*B of the pedestals 11A and 11B, respectively.

FIG. 14 shows a modification of the track traveling toy according to the present invention. The track traveling toy configures the platform 1 to be two stories in height, and to dispose railway tracks also at the second floor platform 1.

According to the track traveling toy by the preferable embodiment of the present invention, a plurality of vehicles can alternately travel. Consequently, various types of plays can be enjoyed.

Moreover, according to the track traveling toy of the present invention, no electric sources, no electric actuators, and the like, are used. Consequently, the track traveling toy can be used at any time and at any place.

The entire disclosure of Japanese Patent Application No. 2007-011636 filed on Jan. 22, 2007 and Japanese Patent Application No. 2007-052649 filed on Mar. 2, 2007 including description, claims, drawings and summary are incorporated herein by reference in its entirely.

Although various exemplary embodiments have been shown and described, the invention is not limited to the embodiments shown. Therefore, the scope of the invention is intended to be limited solely by the scope of the claims that follow.

What is claimed is:

1. A track traveling toy, comprising:

a track;

at least a part of the track being made to be a double track; and automotive vehicle stopping sections which are respectively provided to railway tracks of the double track, wherein an automotive vehicle entering the railway track on one side operates the stopping section of the railway track on the one side to stop the automotive vehicle on the railway track, and operates the stopping section on the other railway track to release a stopping state of an automotive vehicle on the railway track, wherein the track is laid on a base, a pedestal is installed at the track on the base so as to be able to freely emerge, and the stopping section stops the automotive vehicle by allowing a body of the automotive vehicle to run on the pedestal raised over the base to separate driving wheels of the automotive vehicle from the track, wherein a projecting part is formed on an under surface of the pedestal, an actuating lever is disposed on a back surface of the base, and an operation of the actuating lever operates the actuating lever to one side to make the actuating lever abut against the projecting part, and thereby the pedestal is raised, and wherein the actuating lever is urged by a first spring to one side, the actuating lever is made to abut against the projecting part of the pedestal by an urging force of the spring, and a locking section to hold the actuating lever at a position before abutting against the projecting part is disposed.

2. The track traveling toy according to claim 1, wherein:

the locking section includes a locking lever having a notch at an end, and a second spring which urges the locking lever to one side;

a pin is disposed on the actuating lever;

the actuating lever is locked at the position before abutting against the projecting part by engaging the pin with the notch; and the locking lever is operated against the urging force of the second spring by the entering vehicle to release the locking of the actuating lever.

3. The track traveling toy according to claim 2, wherein a slider is disposed before the pedestal in a traveling direction on the back surface of the base;

a claw is disposed on the slider so as to be able to freely emerge above the base;

the slider is urged into a counter direction to the pedestal by a third spring;

the slider is connected with the actuating lever; one of the vehicles entering one side track is engaged with the claw of the slider on the one side to operate the slider on the one side against the urging force of the third spring;

the locking lever on the one side is operated by a movement of the slider to release the locking of the actuating lever on the one side; and the actuating lever on the other side is operated to be separated from the pedestal on the other side.

4. The track traveling toy according to claim 1, further comprising:

a slide piece moving along the pedestal; and a detent mechanism to locate the slide piece at a center position where an end of the slide piece correspond to the projecting part of the pedestal, a front position passing the projecting part, and a rear position before the projecting part, wherein the pedestal is pushed up at the center position of the slide piece by the projecting part and a movement of the end of the locking lever is prevented at the front position of the slide piece.

5. A track traveling toy, comprising:

a single trackway; and a double trackway connected to the single trackway to form a track around which a vehicle runs, the double trackway including first and second tracks both on a base and each including a pedestal and a vehicle stopping section, wherein each pedestal is able to rise through the base and has a projecting part formed on a surface thereof, wherein each vehicle stopping section includes an actuating lever disposed on the base for abutting the projecting part of the pedestal by an urging force, a first spring for urging the actuating lever to one side by the urging force thereof, and a lock section for holding the actuating lever at a position before abutting the projecting part, wherein the actuating lever is urged to one side to abut the projecting part by the urging force of the first spring to raise the pedestal;

wherein the vehicle stopping section of the first track stops a first vehicle entering the first track when the first vehicle runs onto the pedestal raised through the base to separate driving wheels of the first vehicle from the first track, and wherein the first vehicle entering the first track also operates the vehicle stopping section on the second track to release a stopping state of a second vehicle on the second track.

6. The track traveling toy according to claim 5, wherein the locking section includes a locking lever having a notch at an end, and a second spring which urges the locking lever to one side, a pin is disposed on the actuating lever, the actuating lever is locked at the position before abutting the projecting part by engaging the pin with the notch, and the locking lever is operated against the urging force of the second spring by the first entering vehicle to release the locking of the actuating lever.

7. The track traveling toy according to claim 6, wherein a slider is disposed on the base before the pedestal in a traveling direction, a claw is disposed on the slider so as to be able to project above the base, and the slider is urged into a counter direction to the pedestal by a third spring, the slider is connected with the actuating lever, wherein one of the vehicles entering one side of the first or second track engages the claw of the slider on the one side to operate the slider on the one side against the urging force of the third spring, the locking lever on the one side is operated by movement of the slider to release the locking of the actuating lever on the one side, and the actuating lever on the other side of the first or second track is separated from the pedestal on the other side.

8. The track traveling toy according to claim 5, further comprising:

a slide piece moving along the pedestal; and a detent mechanism to locate the slide piece at a center position where an end of the slide piece corresponds to the projecting part of the pedestal, a front position passing the projecting part, and a rear position before the projecting part, wherein the pedestal is pushed up at the center position of the slide piece by the projecting part and movement of the end of the locking lever is prevented at the front position of the slide piece.

* * * * *